US005984551A

United States Patent [19]

Kinney, Jr.

[11] Patent Number: 5,984,551

[45] Date of Patent: Nov. 16, 1999

[54] DISPENSER OF SOLIDS AND SEMI-SOLIDS

[76] Inventor: George C. Kinney, Jr., 661 SE. Fifth Ave., Pompano Beach, Fla. 33060

[21] Appl. No.: 08/845,759

[22] Filed: Apr. 25, 1997

[51] Int. Cl.[6] ..... A45D 40/02; A45D 40/12

[52] U.S. Cl. ..... 401/59; 401/60; 401/83; 401/194

[58] Field of Search ..... 401/59, 60, 83, 401/84, 194

[56] References Cited

U.S. PATENT DOCUMENTS

| | | | |
|---|---|---|---|
| 2,491,241 | 12/1949 | Zuckerman | 401/59 |
| 3,810,700 | 5/1974 | Bryan | 401/59 |
| 3,954,114 | 5/1976 | Ostrowsky et al. | 401/59 X |
| 5,568,989 | 10/1996 | Benguigui | 401/60 X |

FOREIGN PATENT DOCUMENTS

| | | | |
|---|---|---|---|
| 32091 | 7/1981 | European Pat. Off. | 401/59 |
| 729519 | 7/1932 | France | 401/59 |
| 906586 | 1/1946 | France | 401/59 |
| 1491052 | 8/1967 | France | 401/59 |

*Primary Examiner*—Steven A. Bratlie

*Attorney, Agent, or Firm*—Malin, Haley, DiMaggio & Crosby

[57] ABSTRACT

A dispensing applicator for solids and semi-solids is provided that includes a flexible strap and internal guide to actuate a movable holding container within an openable housing, that includes tactile and audible position detent signals to prevent the strap and the solid or semi-solid from inadvertent and accidental movement, and to signal that the supply of solid or semi-solid is nearly exhausted. The openable housing has an opening at one end and a longitudinal slot. The flexible strap is connected at a first end to the solid and semi-solid product holding container, and at the second end to a closure member shaped to tightly fit the open end of the housing The strap fits closely within a space between the internal guide and the housing. The strap includes a non-slip thumb piece that extends to the exterior of the housing through the longitudinal slot. The interior side of the thumb piece has a projecting nub that engages with a plurality of holes in the internal guide to provide tactile and audible position detent signals.

8 Claims, 2 Drawing Sheets

DISPENSER OF SOLIDS AND SEMI-SOLIDS

BACKGROUND OF THE INVENTION

1. Field of the Invention

This invention relates to an improved dispensing applicator for solids and semi-solids and more particularly to a dispensing applicator for solids and semi-solids that uses a flexible strap and internal guide to actuate a movable holding container within an openable housing, and that includes tactile and audible position detent signals to prevent the strap and the solid or semi-solid from inadvertent and accidental movement, and to signal that the supply of solid or semi-solid is nearly exhausted.

2. Description of Related Art

Structures related to the present invention are known in the art. For example, U.S. Pat. No. 3,954,114, issued to Ostrowsky et al., discloses a lipstick case having an exterior cylindrical casing with an opening at one end, and a lipstick carrying cup attached to one end of a flexible actuating strap. The strap and carrying cup are internal to the casing and movable between a retracted and an extended position by manual movement of a finger piece attached to the strap that extends through a longitudinal slot in the case.

Opposite the end of the strap that is attached to the cup is a closure member that covers the open end of the casing. When the cup is moved to the retracted position by movement of the finger piece along the longitudinal slot, the closure member simultaneously is moved into position covering the open end of the casing. When the cup is moved to the extended position by reverse movement of the finger piece, the closure member is removed from, and the product is extended through, the opening in the casing.

The cup, strap, and closure member are guided and controlled by an internal guide member that is closely fit within the interior of the casing.

The longitudinal slot in the casing includes a pair of detent "nibs" at each end of the slot to indicate to the user, by increased friction on the finger piece, when the end of movement of the finger piece is near, and hence when the lipstick is fully extended or fully retracted.

An existing problem with dispensers of the type herein above described is that there is no position indication for the product between the fully extended and the fully retracted positions. When the product is partially extended, any inadvertent or accidental movement of the finger piece results in the unintended movement, either extension or retraction, of the product.

SUMMARY OF THE INVENTION

The present invention provides an improved dispenser and applicator for solids and semi-solids, including such items as make up, lip stick, chap stick, deodorant, chalk, marking tips, wax, glue, erasers, and other items, that includes a housing with an opening at one end and a longitudinal slot. A flexible strap is connected at a first end to a solid and semi-solid product holding container, and at a second end to a closure member shaped to tightly fit the open end of the housing. The holding container receives and retains the solid or semi-solid product that will be dispensed through the opening in the housing, as described below.

The flexible strap includes a finger or thumb piece between the first end and the second end of the strap. The strap fits internal to the housing, as described in detail below, with the thumb piece projecting through the longitudinal slot. Adjacent the thumb piece and on the side of the strap opposite the thumb piece is a protruding nub that faces the interior of the housing when the thumb piece is in position in the longitudinal slot of the housing. The thumb piece includes a non-slip exterior surface that can have a raised transverse ridge for thumb engagement.

A guide member is closely fit internal to the housing to guide the thumb piece, strap, and holding container. The guide member is open at one end and includes an arcuate surface at the opposite end. The open end of the guide member is positioned adjacent the open end of the housing when the guide member is in position within the housing. The guide member includes a longitudinal slot that is preferably positioned opposite the slot within the housing. The holding container fits essentially coaxially within the housing and within the guide member, and is connected to the flexible strap through the guide member's longitudinal slot. The flexible strap extends between the guide member and the interior surface of the housing from its first end at the attachment point to the holding container, around the arcuate end of the guide member, to the thumb piece, and to the closure member at the strap's second end. The arcuate end of the guide member includes parallel ridges that closely fit along the outer edges of the strap to positively guide the strap so that it does not slip or shift thus ensuring smooth operation.

The thumb piece extends outward of the housing through the longitudinal slot in the housing. The portion of the guide member opposite its longitudinal slot includes a plurality of detent. holes sized and positioned to receive at least a portion of the protruding nub on the flexible strap that is adjacent and opposite the thumb piece. As the thumb piece is slid along the longitudinal slot in the housing, the nub enters adjacent detent holes in the guide member providing a tactile and audible "clicking" indication of the position of the thumb piece, the flexible strap, and the holding container. The detent holes located at each end of the guide member are larger than the other holes and sized to receive the entire protruding nub to positively stop the thumb piece at the maximum extended and maximum retracted positions.

In use, the holding container contains a solid or semi-solid product to be dispensed. The thumb piece slides within the longitudinal slot in the housing. The thumb piece is attached to the flexible strap, which is connected to the holding container and guided by the guide member. The thumb piece begins at the fully retracted position with the closure member covering the opening in the housing, and the nub fully received within a large detent hole in the guide member at the thumb piece's fully retracted end.

As the thumb piece is slid along the longitudinal slot in the housing, the nub must be initially forced out of its received position within the large detent hole, requiring a preselected amount of force be applied to the thumb piece. The required positive application of force on the thumb piece virtually eliminates the inadvertent extension of the product. Once the thumb piece begins to move, the attached strap moves pulling the closure member from its resting spot covering the opening in the housing, while simultaneously the holding container, also attached to the strap and carrying the product, begins moving toward the opening in the housing and begins extending the product. At some position as the thumb piece moves, the nub will "click" into the next detent hole, which is sized to receive a small portion of the nub, causing a tactile and audible signal.

A portion of the product may be exposed through the opening in the housing at this position, or if the product has been partially used, the thumb piece can be further moved so the nub will be received by the next detent hole in turn further extending the holding container and the product. The thumb piece can be slid in this manner until the nub falls into the last detent hole in the guide member, which is sized to receive the entire nub, stopping the thumb piece from further extension of the product, and signaling tactually and with an audible click, indicating the fully extended position has been reached.

The thumb piece can then slide in reverse direction, retracting the product, with the nub sequentially being received by each detent hole in turn in reverse order. The thumb piece continues movement until the product is fully retracted, the closure member is in place covering the opening in the housing, and the nub is again received in the large detent hole at the fully retracted position as signaled tactually and audibly.

Accordingly, it is an object of the present invention to provide a solid and semi-solid dispenser that provides tactile and audible feedback of a plurality of positions of extension and retraction of the solid or semi-solid.

It is another objective of the present invention to provide a solid and semi-solid dispenser that includes a non-slip thumb piece and smooth slip-free operation.

In accordance with these and other objects which will become apparent hereinafter, the instant invention will now be described with particular reference to the accompanying drawings.

DESCRIPTION OF THE PREFERRED EMBODIMENTS

Figure 1:
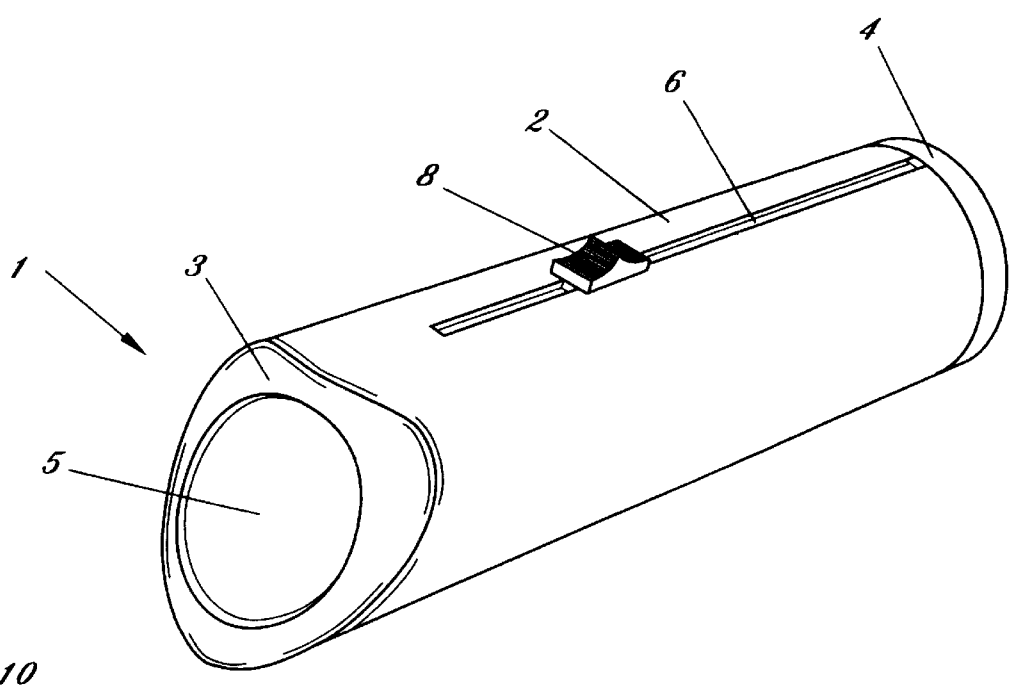
FIG. 1 is a perspective view of the preferred embodiment of the present invention.

Referring now to FIG. 1, the present invention 1 includes housing 2, end cap 4, and openable end 3. Housing 2 can be cylindrical in shape and includes a longitudinal slot 6 which thumb piece 8 longitudinally slides within, as fully described below. Open end 3 is covered by a closure member 5 when the product to be dispensed is retracted within housing 2. Housing 2 can be made of metal, plastic, or other material.

Figure 3:
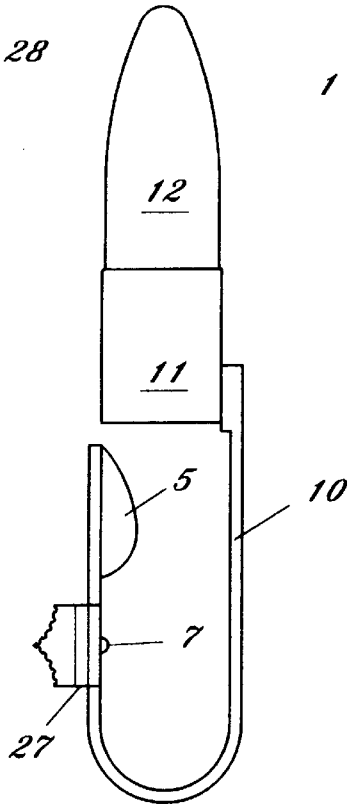
FIG. 3 is a side elevational view of the strap of FIG. 2.
Figure 2:
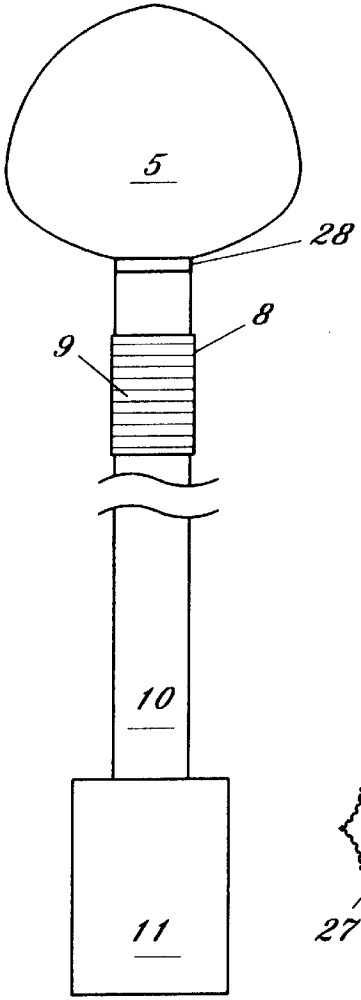
FIG. 2 is a top plan view of the flexible strap of the embodiment of FIG. 1 of the present invention.

Referring now to FIG. 2, closure member 5 is connected to one end of flexible strap 10. The other end of flexible strap 10 is connected to holding container 11. Referring also to FIG. 3, holding container 11 holds solid and/or semi-solid product 12 to be dispensed. Thumb piece 8 is connected to strap 10 between the ends of flexible strap 10, and preferably adjacent closure member 5. Thumb piece 8 can include non-slip surface 9 with a raised transverse ridge to provide a sure grip to a user's thumb or finger when applying pressure to thumb piece 8. Flexible strap 10 includes a raised protruding nub 7, of somewhat hemispherical shape, on the side opposite thumb piece 8, the purpose of which will be fully described below.

As shown in FIGS. 2 and 3 and described further below, flexible strap 10 must be bendable and resilient. Flexible strap 10, closure member 5 and holding container 11 are preferably made of a single piece of molded plastic material, but can alternately be made as separate pieces connected together, and can be made of other materials so long as it is bendable and resilient such that when flexible strap 10 is bent it returns to the unbent position.

Figure 4:
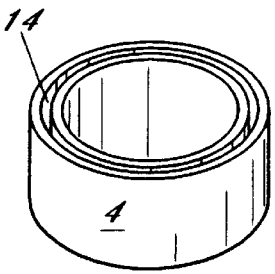
FIG. 4 is a perspective view of the end cap of the embodiment of FIG. 1.

Referring to FIG. 4, end cap 4 preferably includes a fitted portion 14 that is easily compression fit into housing 2 opposite end 3. Compression fit of end cap 4 into housing 2 simplifies assembly of dispenser 1.

Figure 5:
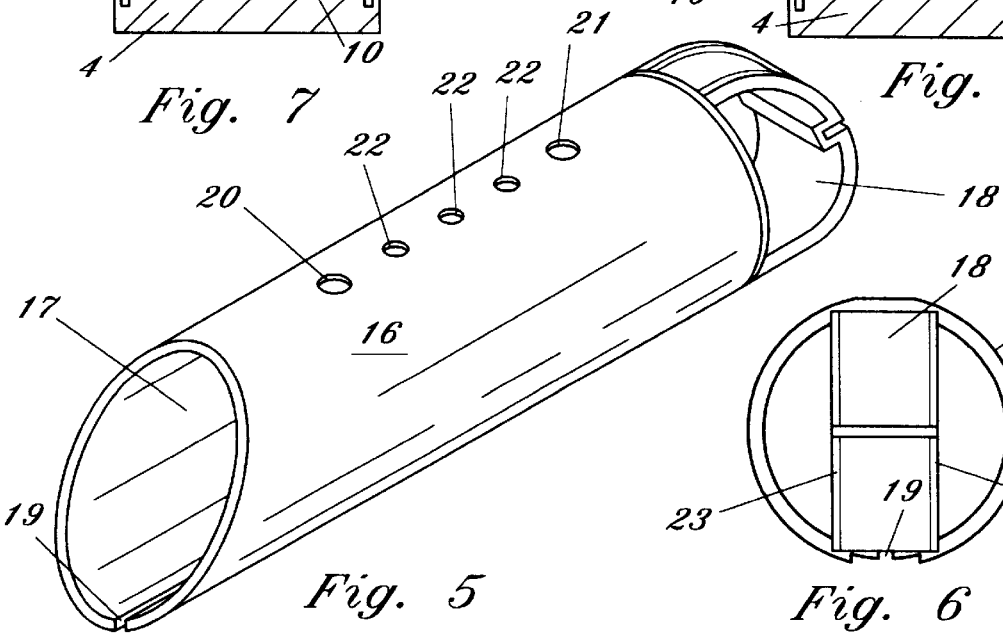
FIG. 5 is a perspective view of the guide member of the embodiment of FIG. 1.

Referring now to FIG. 5, internal guide member 16, which can be similar to the shape of housing 2 and in the preferred embodiment is cylindrical, is sized to closely fit the interior of housing 2 with the open end 17 adjacent to openable end 3 of housing 2. Guide member 16 includes an arcuate end member 18 and a longitudinal slot 19. Guide member 16 includes apertures 20 and 21 positioned near each end of guide member 16 and which are sized in diameter to receive the diameter of protruding nub 7 on strap 10. Guide member 16 further includes a plurality of apertures 22 sized in diameter to receive only a portion of nub 7, and preferably sized approximately one half of the diameter of nub 7. Apertures 20–22 are positioned opposite longitudinal slot 19 on guide member 16. Guide member 16 can be made of plastic or other material to form a smooth low friction surface against flexible strap 10.

Figure 6:
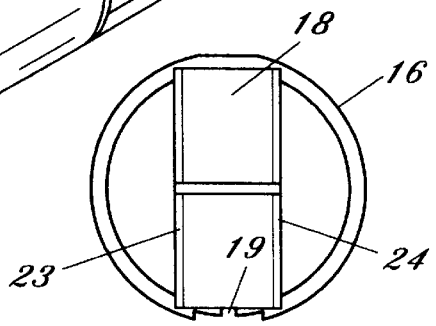
FIG. 6 is a bottom plan view of the guide member of FIG. 5.

Referring also to FIG. 6, arcuate end member 18 includes parallel raised ridges 23 and 24 which are spaced wider than the width of flexible strap 10 to guide and maintain the position of flexible strap 10 around arcuate end member 18.

Figure 7:
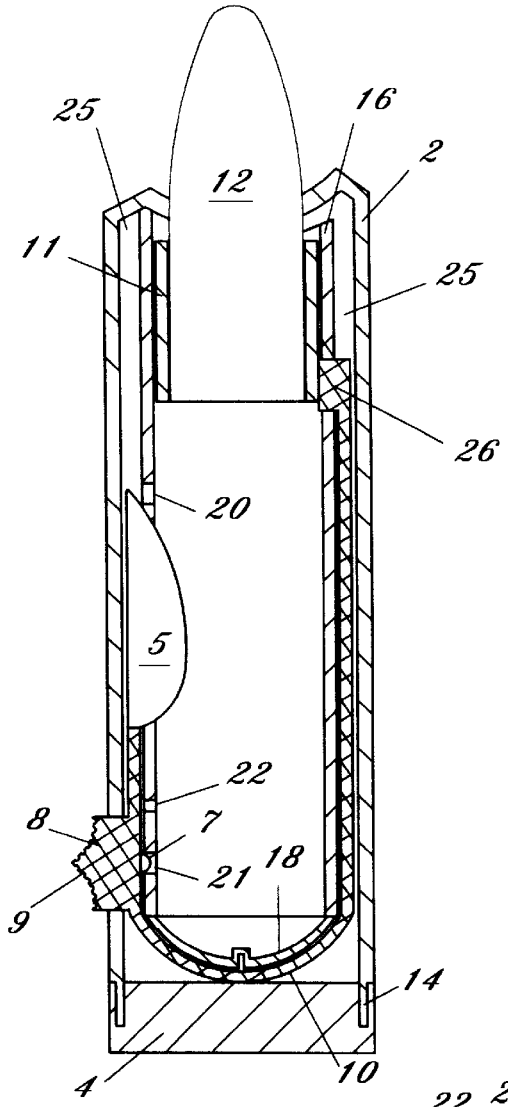
FIG. 7 is a side elevational view in cross-section of the embodiment of FIG. 1, fully extended.
Figure 8:
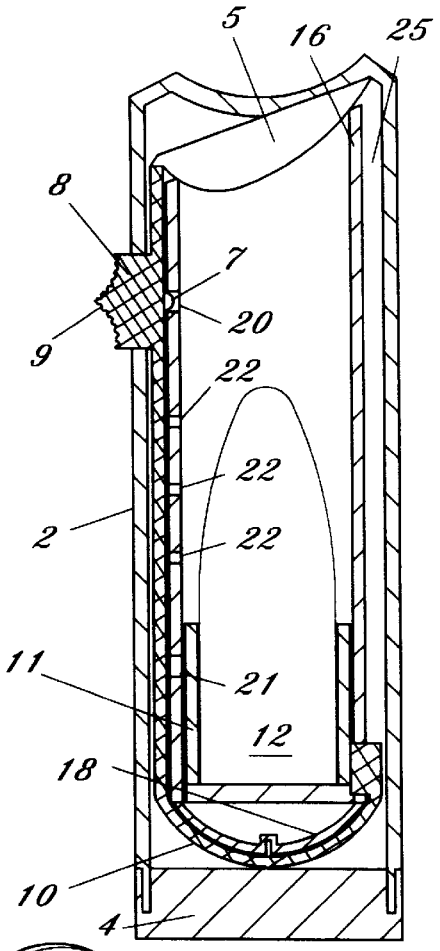
FIG. 8 is a side elevational view in cross-section of the embodiment of FIG. 1, fully retracted.

Referring now to FIGS. 7 and 8, guide member 16 fits coaxially and closely within the interior of housing 2 with open end 17 adjacent housing end 3, and apertures 20-22 positioned directly below slot 6 in housing 2. Slot 19 of guide member 16 is positioned opposite and interior to slot 6 on housing 2.

Flexible strap 10 fits into space 25 between housing 2 and guide member 16. Space 25 fit closely to flexible strap 10, but permits flexible strap 10 to slide in relation to housing 2 and guide member 16. Holding container 11 fits coaxially within the center of guide member 16 and housing 2 and is connected to flexible strap 10, through slot 19 in guide member 16, at narrow connection 26. Narrow connection 26 is sized to be longitudinally slidable in slot 19. Flexible strap 10 is guided around arcuate member 18 and is held in place by ridges 23 and 24 (visible in FIG. 6). Thumb piece 8 is connected to flexible strap 10 near closure member 5.

Thumb piece 8 extends exterior of housing 2 through slot 6 at narrow connection 27. Narrow connection 27 is sized to be longitudinally slidable in slot 6. Nub 7 extends opposite thumb piece 8 and faces interior to housing 2. Apertures 20 and 21 are sized and positioned to fully receive nub 7 at the fully retracted position shown in FIG. 8, and at the fully extended position shown in FIG. 7, respectively. Apertures 22 are positioned between apertures 20 and 21, and are sized to receive only a portion of nub 7.

Closure member 5 is connected to flexible strap 10 at the end opposite the holding container 11. Closure member 5 is sized and shaped to cover the opening in housing end 3 when thumb piece 8 is in the fully retracted position as shown in FIG. 8. Closure member 5 slidably fits into space 25 when thumb piece 8 is moved into an extended position, as shown in FIG. 7.

Referring back to FIG. 2, flexible strap 10 can include a hinge member 28 at the connection point of closure member 5 to flexible strap 10 to further facilitate flexible movement of closure member 5.

In operation, referring first to FIG. 8, thumb piece 8 is in the fully retracted position with nub 7 engaged within aperture 20, holding container 11 and the solid or semi-solid product 12 is fully retracted within housing 2. Closure member 5 is fully covering open end 3 of housing 2.

Upon applying sufficient force on thumb piece 8 in the direction away from open end 3 of housing 2, nub 7 can be dislodged from within aperture 20 with an accompanying tactile sensation. Upon continued application of force, thumb piece 8 will begin sliding within slot 6. As described above, thumb piece 8 is connected to flexible strap 10 which will simultaneously begin to slide within space 25. Also simultaneously, closure member 5 will begin to move away from open end 3 and holding container 11 will begin to move toward open end 3.

With continued application of force to thumb piece 8, flexible strap 10 will continue to slide within space 25, closure member 5 will move completely away from the open end 3 of housing 2 into space 25, and holding container 11 will move further toward open end 3 of housing 2 and product 12 will extend through open end 17 of guide member 16 and through open end 3 of housing 2. At a preselected position, nub 7 will partially engage the first aperture 22 with a corresponding tactile and audible signal indicating the first intermediate position has been reached.

The first and subsequent intermediate positions are the positions in which nub 7 engages the plurality of apertures 22 which are spaced between apertures 20 and 21. The first and subsequent intermediate positions are preselected and determined by the amount of product 12 that is desired to be extended from within housing 2 and will depend on the nature of the product to be dispensed and how it is used.

The pre-positioned stops created by apertures 22 and nub 7 prevents the over-exposure of product 12 from housing 2 and eliminates the risk that product 12 will break off due to overexposure as can happen if a similar device were utilized without the improvements of the present invention.

To extend the product beyond the first intermediate position, sufficient force is again applied to the thumb piece 8 to disengage nub 7 from the aperture 22 nearest aperture 20, again accompanied by a tactile sensation. The amount of force required to move nub 7 from aperture 22 is less than that required to move nub 7 from either aperture 20 or 21.

Continued force can be applied to thumb piece 8 until the next intermediate position is reached and nub 7 is engaged within the next aperture 22 again accompanied by a tactile and audible signal. The extension of product 12 can continue as described until nub 7 is received within aperture 21 at the fully extended position, as shown in FIG. 7.

When nub 7 is received in aperture 21, the tactile and audible signals are more pronounced thus signaling to the user that the fully extended position has been reached. Further force applied to thumb piece 8 will not result in further extension of product 12 as the end of travel of thumb piece 8 within slot 6 has been reached.

Reversing the direction of applied force to thumb piece 8 will begin the process in reverse to retract product 12. When the fully retracted position is again reached as shown in FIG. 8, nub 7 will be received in aperture 20 with a corresponding tactile and audible signal or "click" that the user will immediately recognize as indicating the product 12 is fully retracted within housing 2. Once in the fully retracted position, the force required to begin the extending process as described above, prevents the inadvertent extension of product 12 as can happen if a similar device were used without the improvements from the present invention.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A dispensing container comprising:

an elongated housing having an openable end an enclosed end and a longitudinal slot;

a flexible strap having an exposed thumb piece, said thumb piece extending through said longitudinal slot of said elongated housing;

a closure member sized to cover said openable end of said elongated housing, said closure member connected to said flexible strap;

means for holding a solid or semi-solid material connected to said flexible strap and slidably received within said elongated housing;

means for guiding said flexible strap within said elongated housing for movement between a fully retracted position wherein said closure member is covering said openable end of said elongated housing and said means for holding is adjacent said enclosed end of said elongated housing, and a fully extended position wherein said closure member is removed from said openable end and said means for holding is adjacent said openable end of said elongated housing, said means for guiding including a guide member received within said elongated housing and including a longitudinal slot and a plurality of apertures spaced apart and opposite said longitudinal slot;

said thumb piece including a raised nub facing the interior of said elongated housing, said nub partially receivable within said plurality of apertures and fully receivable within at least two of said plurality of apertures corresponding to said fully retracted position and said fully extended position; and means for tactile and audible signaling of said fully retracted position and said fully extended position, and a plurality of intermediate positions spaced apart between said fully retracted and said fully extended positions, said means for tactile and audible signaling includes said nub being received within each of said plurality of apertures with a preselected force by a preselected clearance between said guide member and said elongated housing for slidably receiving said flexible strap and biasing said nub into said plurality of apertures.

2. A dispensing container as in claim 1 wherein a force applied to said thumb piece moves said flexible strap between said fully retracted position and said fully extended position.

3. A dispensing container as in claim 2 wherein said thumb piece includes a relatively high friction exterior surface having a raised transverse central portion for a relatively non-slip engagement with a user's thumb.

4. A dispensing container as in claim 1 wherein said enclosed end includes an end cap compression fit within said elongated housing.

5. A handheld despensing container for applying material to human lips comprising:

a housing having an openable end and a longitudinal axis and a longitudinal slot;

a hollow guide member received within said housing having a longitudinal axis collinear with said longitudinal axis of said housing, said guide member having an open end adjacent said housing openable end and an arcuate end surface at an end opposite said guide member open end, said arcuate end surface having a pair of spaced apart parallel raised guide ridges, said guide member having a longitudinal slot opposite said longitudinal slot in said housing, said member having a plurality of apertures adjacent said guide member open end and a second of said plurality of apertures adjacent said guide member arcuate end surface;

a closure member attached to said housing;

a flexible strap having a first end and a second end connected to said closure member, said closure member sized to cover said housing openable end, said flexible strap sized to slidably fit within a space between said housing and said first end and said second end received within said pair of raised guide ridges on said arcuate end surface of said guide member;

a holding container longitudinally slidably received within said guide member and connected to said first end of said flexible strap through said longitudinal slot in said guide member;

a longitudinal slidable thumb piece extending externally to said housing and connected, through said longitudinal slot in said housing, to said flexible strap between said first end and said second end;

said flexible strap including a raised nub opposite said thumb piece and extending interior to said housing, said nub partially receivable within each of said plurality of apertures and fully receivably within said first and said second of said plurality of apertures;

said closure member connected to said flexible strap at said second end and adjacent said thumb piece, said closure member sized to cover said openable end of said housing and to slidably fit between said housing and said guide member;

said thumb piece being slidably movable from a fully retracted position wherein said thumb piece is adjacent said openable end of said housing, said nub is received within said first of said plurality of apertures, said closure member is fully covering said housing openable end, and said holding container is adjacent said arcuate end member, to a fully received within said second of said between said housing and said guide member, and said holding container is adjacent said openable end of said housing; and, wherein when said thumb piece is moved from said fully retracted position toward said fully extended position, and said flexible strap is simultaneously slid between said housing and said guide member and is guided around said guide member arcuate end surface to slide said holding container within said guide member, said nub is partially received in turn within each of said plurality of apertures providing a tactile and audible signal to a user upon begin received therein and providing a slightly different tactile and audible signal to the user when fully received within said first and said second of said plurality of apertures to signal the fully retracted and fully extended positions respectively, said nub being received within each of said apertures by a preselected biasing force to provide said tactile and audible signal.

6. A dispensing container as in claim 5 wherein said thumb piece includes a relatively high friction exterior surface and a raised transverse central portion.

7. A dispensing container as in claim 5 wherein said housing and said guide member are cylindrical in shape.

8. A dispensing container as in claim 5 further including an end cap compression fit within said housing at an end opposite said openable end.

* * * * *